United States Patent [19]

Heidemann

[11] Patent Number: 4,708,328

[45] Date of Patent: Nov. 24, 1987

[54] BRICK-LINING A METALLURGICAL VESSEL

[75] Inventor: Wolfgang Heidemann, Duisburg, Fed. Rep. of Germany

[73] Assignee: Mannesmann AG, Duesseldorf, Fed. Rep. of Germany

[21] Appl. No.: 722,127

[22] Filed: Apr. 10, 1985

[30] Foreign Application Priority Data

Apr. 12, 1984 [DE] Fed. Rep. of Germany ..... 3413806

[51] Int. Cl.[4] ..... C21C 5/44

[52] U.S. Cl. ..... 266/281; 52/749

[58] Field of Search ..... 266/281, 280; 52/747, 52/749; 264/30

[56] References Cited

U.S. PATENT DOCUMENTS 3,287,875 11/1966 Lakin ..... 52/749

3,757,484 9/1973 Williamson et al. ..... 52/749

4,303,363 12/1981 Cervin ..... 266/281

FOREIGN PATENT DOCUMENTS 2504711 9/1975 Fed. Rep. of Germany ..... 266/281

*Primary Examiner*—L. Dewayne Rutledge

*Assistant Examiner*—S. Kastler

*Attorney, Agent, or Firm*—Ralf H. Siegemund

[57] ABSTRACT

A metallurgical vessel having a closed bottom such as a steel converter is brick-lined by using a work area and platform being suspended for lifting and lowering into the vessel and carrying structure for distributing lining bricks along the periphery of that platform; delivery equipment is separately and removably affixed to the upper and lower sides of said work area and platform, so that in various, combinations the bottom, the wall and the transition between bottom and wall can be lined.

10 Claims, 3 Drawing Figures

BRICK-LINING A METALLURGICAL VESSEL

BACKGROUND OF THE INVENTION

The present invention relates to brick lining of metallurgical vessels, particularly steel converters, having a closed bottom; the brick lining being effected under utilization of a work area, platform or table being liftable and lowerable. Furthermore, it is assumed that a transport device is provided for feeding bricks to the work area and platform. Also there should be a device for distributing the bricks towards and around the periphery of the work area and platform. Finally delivery equipment should be provided for transferring individual bricks from the work area and platform to the final position in the vessel to be lined.

Devices of the foregoing type and arrangements are known for brick lining metallurgical vessels, whereby particularly economy of, ultimately, the making and metal processing dictates the assembly needed for that purpose. Ultimately the metal working and metal processing particularly the making of steel or the like, has to be economized and the method for lining the metallurgical vessel requires adaption towards the ensuing metal working process, requiring particularly a predetermined profile of the brick lining itself.

A device for brick lining metallurgical vessels of the foregoing type is for example disclosed in German printed patent application No. 28 46 544 (see also U.S. Pat. No. 4,303,363). This known device handles the individual bricks quite satisfactorily. Nevertheless, it was found that this particular arranement still requires a very extensive component of manual labor, particularly in the beginning of the brick lining process. It was found here particularly that in the bottom area of the metallurgical vessels the bricks can be placed by automation or partial automation with great difficulties only; skilled manual labor is mandatory indeed. These difficulties become particularly noticeable if for one reason or another the weight of the bricks increases for example, on account of increasing the length of the respective brick.

DESCRIPTION OF THE INVENTION

It is an object of the present invention to provide a new and improved arrangement by means of which the brick lining of a metallurgical vessel is freed as much as possible from manual labor, particularly in those cases when the weight of the individual bricks exceeds 32 kg assuming therefore that in such cases manual labor is deemed outright inadmissible.

In accordance with the preferred embodiment of the present invention it is suggested to provide a general work area to form a raisable and lowerable platform and being provided with at least one upper and at least one lower delivery equipment; both being removable from the platform. The lower delivery equipment is provided for the bricks for lining the bottom of the vessel, and is moreover removable from the work area. The upper delivery equipment cooperates with the lower one and, by itself, is used for lining the bottom-to-wall transition arrea in the vessel.

Surprisingly it was found that this simple arrangement reduces particularly in the bottom area a great deal of manual labor. Moreover the arrangement surprisingly is such that bricks that were longer than the usual 720 mm such as 1350 mm can indeed still be handled. Therefore the invention permits establishing a brick lining for a the bottom which is thicker than before while the disadvantages of manual brick lining are no longer encountered. A particular advantage is moreover to be seen in that the transition zone in the brick lining from bottom to side wall of the vessel is carried out after removal of the lower delivery equipment so that the working area and platform, after removal of the lower delivery equipment will have only minimal structural height and can therefore be lowered to the level of the bottom lining itself. This then minimizes the level to be negotiated for the delivery of the bricks frrom the working area and platform to the lower wall portions of the vessel in the aforementioned transition area.

After the bottom of the vessel has been lined and after the transition area to the wall has been established, for example through several layers of bricks, the device in accordance with the further feature can be simplified in that also the upper delivery device is dismanteled and removed prior to completing the lining of the straight up wall of the vessel. It was found that if the height distance between work area and platform, and the lowest layers has become very small in the upper portion of the vessel wall it is feasible to shift the bricks in a horizontal level under layer for layer adjustment of the work area, so that indeed further auxiliary equipment of that platform is not necessary.

In accordance with a further feature of the invention it is suggested to provide the respective delivery equipments in each instance with a horizontal pivot arm and a gripping device or the like, for gripping, holding and handling a single brick. This configuration eliminates the need for particular types of grippers and, therefore, lowers investment costs for the equipment. Under this aspect the equipment generally can be improved further by mounting the pivot arm for rotation on a column or pillar and the column or pillar is fastened to a frame, which in turn bears against the edge or rim of the work area and platform. This arrangement is favorable as far as the distribution of supporting forces is concerned. These forces, are derived from the weight of the parts themselves as well as from the weight of the bricks themselves.

In accordance with a further feature of the invention it is suggested to provide the one aforementioned column or pillar serving as the delivery equipments on the respective lower side of the platform, with a pivotable or rotatable support platform. This rotatable support platform serves as a storage buffer so that at least one or possibly several bricks can be stored temporarily before being passed on to the lining operation proper.

A rotatable work area and platform, particularly any extensive masses to be moved are avoided, in that a holding frame for the delivery equipment is arranged moveably at the periphery of the work area and platform. This feature particularly involves the utilization of rails, which in turn establishes favorable conditions for the support of this frame. Affixing such guide and support structure for the holding frame is facilitated further, in that the rails for the holding frame are mounted on and along the periphery of the work area and platform are provided particularly on a turntable of the distributing structure.

The gripping devices can reach sufficiently far and particularly their range in terms of areal coverage is increased by providing the pivot arms of the respective delivery equipment as hinged and jointed arms.

The placement of bricks in the bottom and wall area of the metallurgical vessel is facilitated further by providing the gripping members on the horizontal pivot arms either as horizontal or vertical gripping members.

Upper parts of the metallurgical vessel are lined in a particularly simple manner if, for removed upper and lower delivery equipment, a releasable transfer roller track is provided on the holding frame. This feature permits moving bricks in the above mentioned horizontal plane of the platform without any extensive expenditure of force.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereo will be better understood from the following description taken in connection with the accompanying drawings in which:

Figure 1:
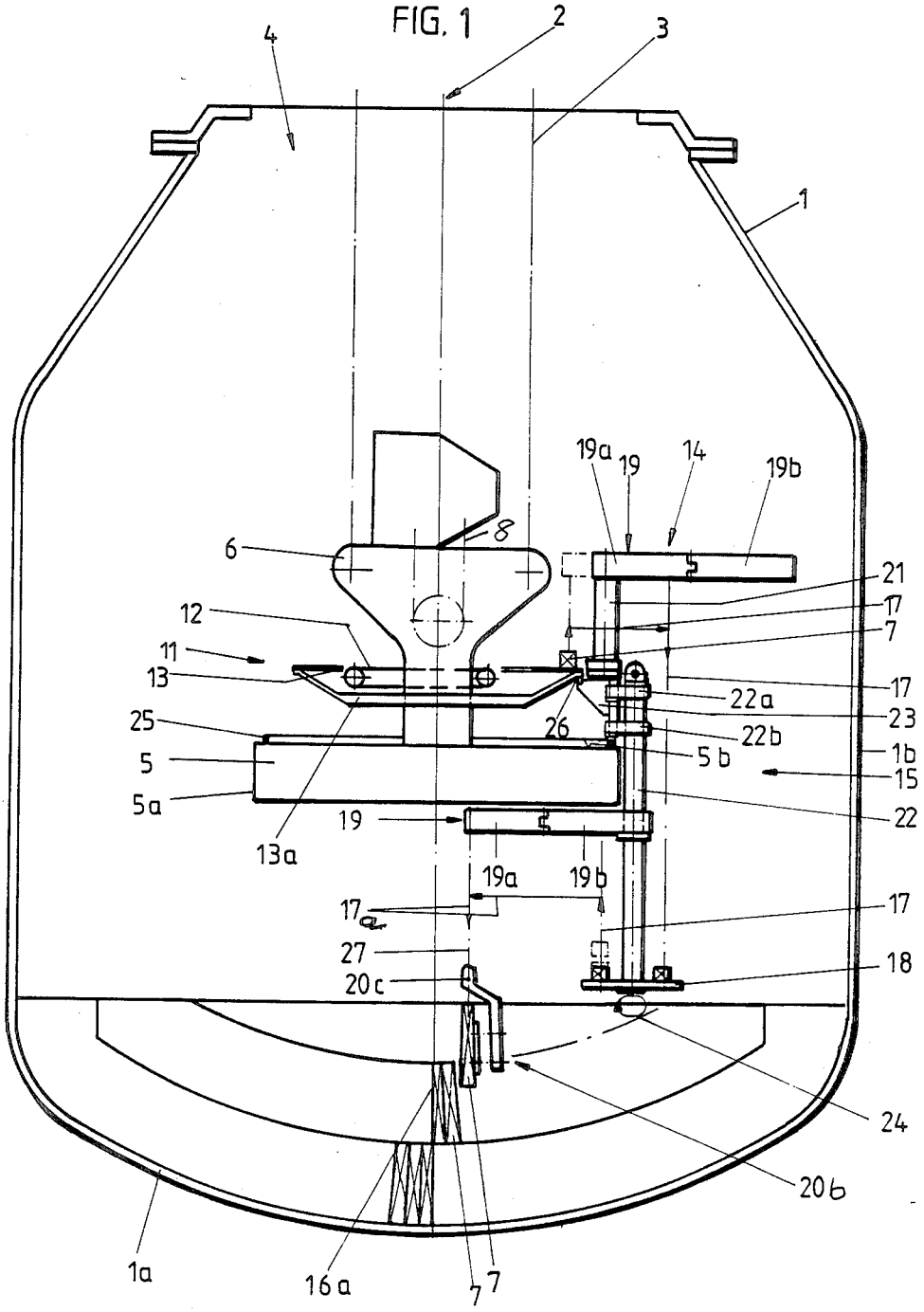
FIG. 1 is a vertical section view through a steel work converter, and being shown during a brick lining operating of the bottom of this vessel.

Proceeding now to the detailed description of the drawing, a device is shown in these figures for brick lining the interior of a metallurgical vessel having an outer jacket 1. The brick lining procedure occurs particularly after the bottom 1*a* of the vessel has been closed. Closing assumes for example that a removable bottom 1*a* is provided in the first place, but that is not essential,—in any event, the bottom of the vessel to be lined is presumed to be closed and connected to the wall thereof.

A brick lining device is suspended for example by means of a crane or the like suspension being provided by cable such as 2 and 3. These cables 2 and 3 enter the vessel through upper opening or mouth 4 thereof. The cable carry a work area and platform 5 and they are provided to place that work area and platform 5 into the required operating position for effecting the brick lining in what ever level that operation is required. The cables 2 and 3 in particular are affixed to a traverse 6 which is rigidly connected to the platform 5. Multiple cable suspension ensures stability of positioning.

Lining-bricks such as 7 are provided through a chain conveyor 8 and through a not further illustrated but only schematically indicated transport device 9. This device 9 in coopereation with the chain conveyor 8 feeds bricks towards the platform 5. These bricks are placed in trough like containers 10 (FIG. 3), to be ultimately placed onto the work platform and area 5. A distributing device 11 is provided on the platform 5 being comprised of a conveyor belt 12 and an annular turntable 13. The belt 12 of the distributing device 11 transport the bricks 7 from a more central area towards the turntable 13 adjacent the periphery 5*a* of the work area and platform 5. This way the bricks 7 are transported to the periphery 5*a*. Thereafter each brick 7 will be placed by an upper delivery equipment 14 or a lower delivery equipment 15 or both into the particular position such as position 16*a* indicated in FIG. 1 or 16*b* in FIG. 2 or 16*c* in FIG. 3.

Figure 2:
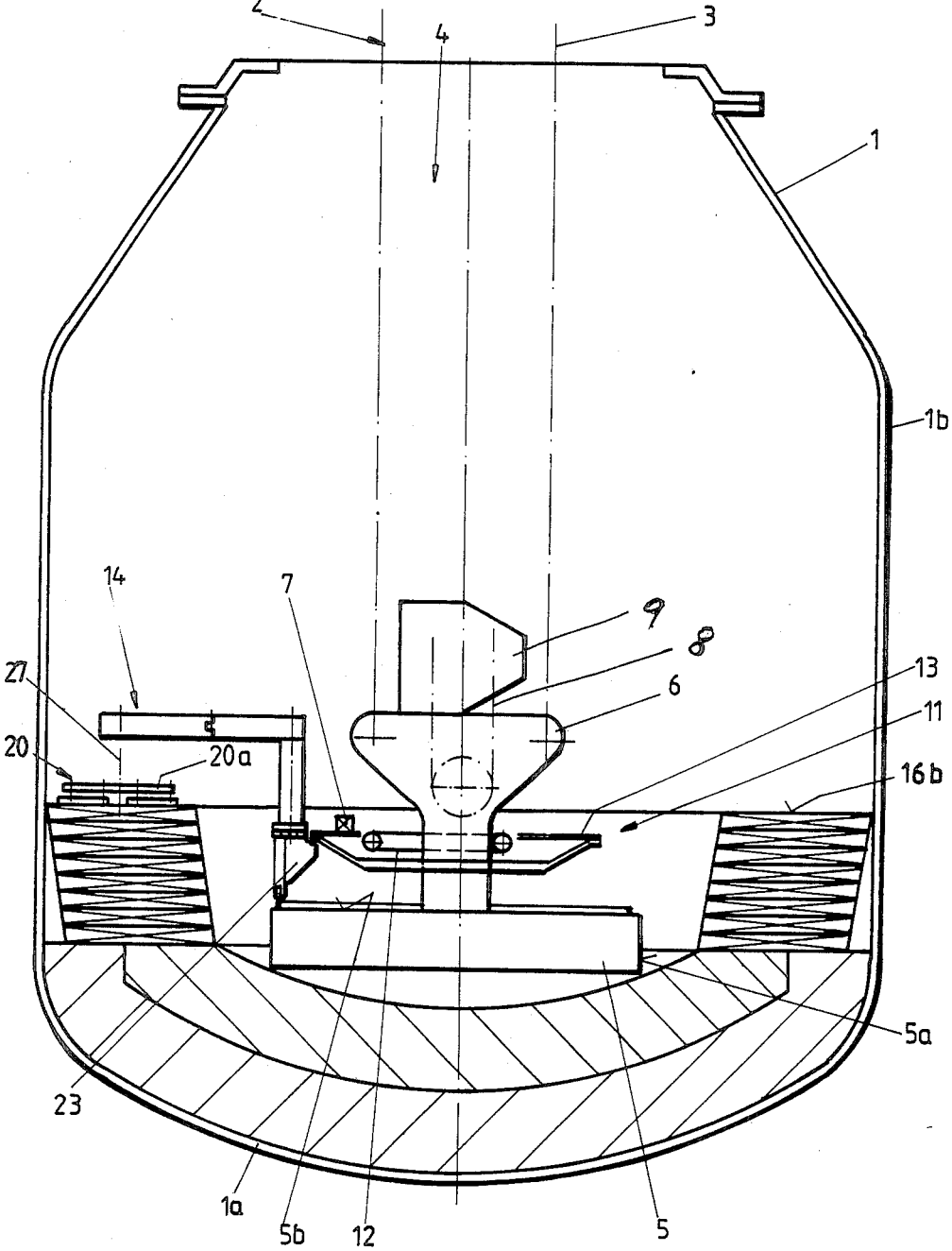
FIG. 2 illustrates a cross section similar to FIG. 1 showing brick lining for the transition between bottom and wall.

As far as the delivery equipment 14 and 15 is concerned they are each provided with pivot arms such as 19 in order to provide for requisite movements placements and positioning operations. The pivot arm 19 in each instance is equipped with a gripper 20. Such a gripper 20 may for example be constructed as a known electro tractor device or a suction cup device. The gripper in FIG. 1 is constructed as electric traction device 20*b*. In FIG. 2 the delivery equipment 14 is provided with a suction cup gripping structure 20.

The pivot arms 19 are rotatable, and mounted for rotation on a column such as post column or pillar 21 for the device 14, and post 22 for the device 15. The two posts, pillars or columns 21 and 22 are arranged on a holding frame 23 which bears against the edge or rim 5*b* of the platform and work area 5.

The lower pillar or post 22 is fastened particularly to the frame 23 and is provided with a rotatable support platform 18 to serve as an intermediate storage and buffering of bricks. For supporting and mounting the lower post 22 fastenings 22*a* and 22*b* are being provided accordingly. The buffer platform 18 is pivotable and rotatable about its longitudinal axis and in direction of arrow 24. As dimensions are considerably smaller than platform 5. This way it is possible to have every part of the bottom of the vessel within reach of the brick lining equipment that extends below the underside of platform 5.

The post, pillars or columns 21 and 22 can be placed by means of the moveable holding frame 23 to any position along the periphery 5*a* of the work platform 5. Also it is possible to provide this work area and platform 5 rotatable with respect to the traverse 6 through suitable rotatable mounting and the providing of a drive motor. This feature would render those features unnecessary which make the holding frame 23 moveable. In case of a platform 5 which is not provided for rotation, guiding and support of the hold frame 23 is provided by means of rails 25 arranged along the periphery 5*b* of the work area and platform 5 and rails 26 are provided which are connected to the turntable frame 13*a*.

The turntable 13 itself is provided with its own rotatable mounting structure at a turntable frame 13*a*. The requisite radii for receiving and placing a brick 7 will be established through hinge arms 19*a* and 19*b* of the respective pivot arms 19. The grippers 20 are constructed so as to permit vertical placement of bricks, in which case vertical gripping is provided as per 20*b* shown in FIG. 1, whereby these particular vertical grippers 20*b* are fastened by means of tension means 27 and pivot axis 20*c* in order to obtain the requisite freedom of movement in the direction of the arrow 17. In order to obtain the particular position 16*b* in FIG. 2 one needs horizontal gripper arms and arrangements 20 which are likewise fastened to tension means 27.

As per FIG. 1 the brick 7 is moved in direction of the composite arrow 17. by means of the upper delivery equipment 14, from edge 5*a* onto a rather low support platform 18 being suspended from equipment 15; and from the platform 18 the brick is moved by means of the lower delivery equipment 15 into the particular final position such as any of these positions 16*a*. Arrow path 17*a* delineates the placement path for the bricks as carried out by equipment 15. The particular operation of lining the bottom of the converter vessel with bricks therefore requires both delivery equipment 14 and 15.

The bricks are basically placed in vertical position right at the bottom of the vessel; closer to the periphery they have slight inclination towards the vertical. This mode of operation is particularly of advantage if the bricks 7 are for example 720 mm or longer for example 1350 mm.

Proceeding now to FIG. 2 here is illustrated the process of lining the transition between wall and bottom. This makes it desireable to lower the platform and work area 5 and to remove the lower delivery equipment 15 so as to permit placement of the platform very close to the previously lined bottom. This way the space next to the lined bottom is immediately and directly accessible to the delivery equipment 14 on the platform 5.

Again, bricks are moved by means of the transport device 9 placed onto the conveyor belt 12 and moved from there onto the turntable 13 to be placed into the range of the gripper of the delivery equipment 14. Now the bricks can be placed more or less in a horizontal position, and into the final disposition of lining being indicated by reference numeral 16*b*. As soon as a particular level, such as 16*b'* is reached, the delivery equipment 14 is no longer necessary and wall lining can begin as shown with reference to FIG. 3.

Figure 3:
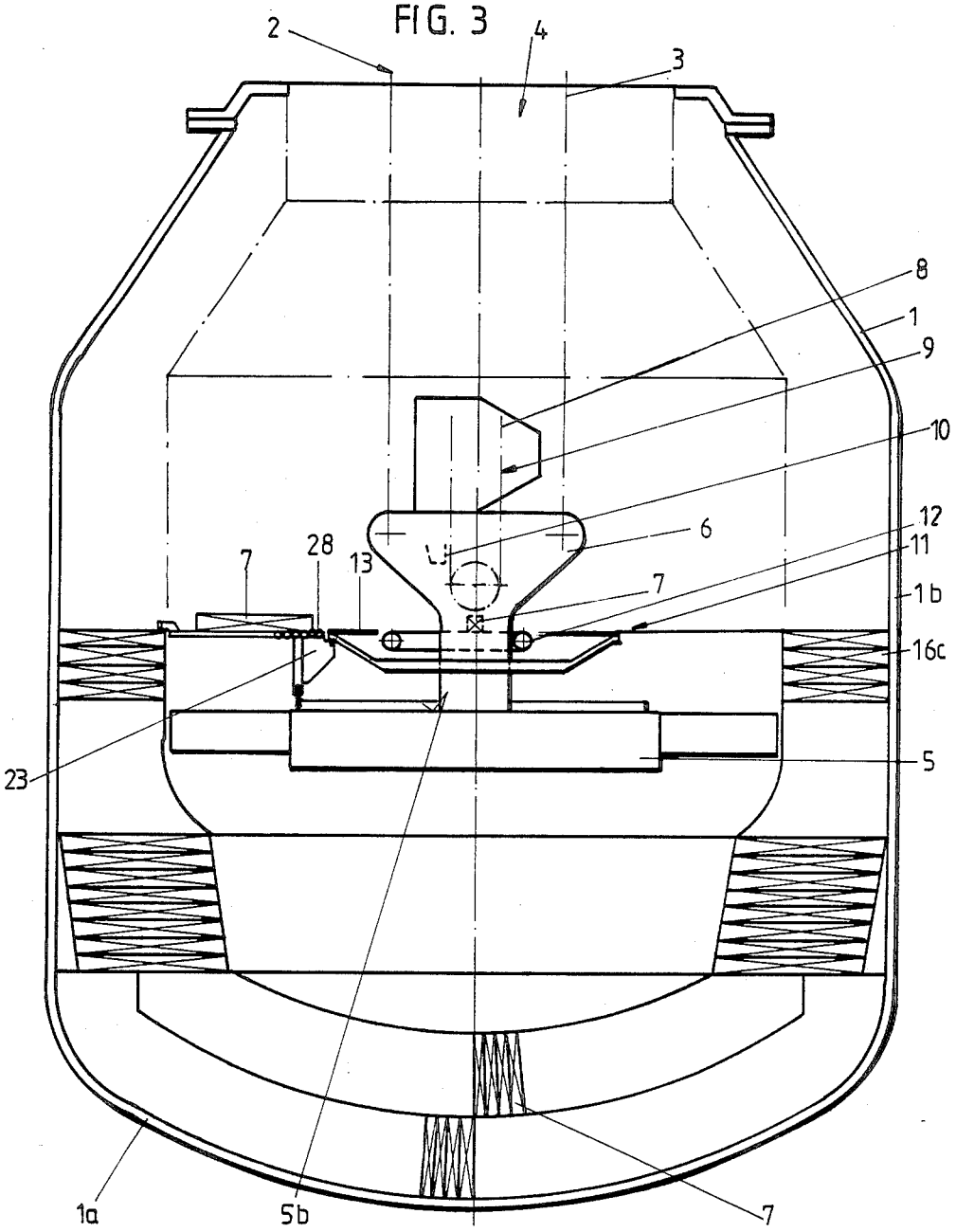
FIG. 3 illustrates still the same cross section as far as the steel works converter is concerned shown in FIGS. 1 and 2 but during brick lining of wall portions above the transition zone.

After dismounting and removal of both the lower and the upper delivery equipments 14 and 15 as explained the holding frame 23 serves to support a transition and bridging roller track 28 so that the brick 7 on conveyor belt can be shifted through the turntable 13 and this supplemental roller track 28 into the position 16*c* as described. As shown in FIG. 3 particularly the upper equipment 14 is now likewise removed and the brick 7 will be placed into their final horizontal position 16*c*. This operation involves merely the belt 12 and the roller track 28 as far as horizontal shifting is concerned; vertical positioning is carried out by gradually lifting the platform 5 through the cable 2 and 3.

The invention is not limited to the embodiments described above, but all changes and modifications thereof, not constituting departures from the spirit and scope of the invention are intended to be included.

I claim:

1. Device for brick lining metallurgical vessels, the respective vessels having a closed bottom, the device including a work area and platform being suspended for lifting and lowering into said vessel, further including a means for distributing lining bricks along the periphery of the work area and platform, the improvement comprising:

at least one brick delivery means removably affixed to the platform so as to extend above an upper side of said work area and platform, for moving bricks from a position resulting from operation of said distributing means, over and beyond said work area and platform; and at least one, additional lower brick delivery means removably affixed to said platform and having a portion that extends below the lower side of said work area and platform, for receiving aligning bricks from said upper brick delivery means and placing them into a position below, including but not exclusively for the bottom of the vessel to be lined, said platform portion being of such dimensions which are smaller than said platform, so that every portion of the bottom of the vessel is within reach of said lower brick delivery means below said platform.

2. Device as in claim 1, wherein each of said brick delivery means includes a horizontally extending vertically pivoting arm with gripping means for lining bricks at their respective ends.

3. Device as in claim 2, wherein each brick delivery means further includes a post upon which the respective pivot arm is pivotably mounted, there being a holding frame bearing against a rim of said work area and platform, said post being affixed to said holding frame.

4. Device as in claim 1, wherein said lower brick delivery means includes a downwardly extending rotatable platform to provide for buffer storage, said upper brick delivery means placing a lining brick onto said buffer storage platform, said lower brick delivery means removing a lining brick from said platform and placing it into final position.

5. Device as in claim 3 wherein said frame is moveable along the periphery of said work area and platform.

6. Device as in claim 5, wherein said holding frame bears against rails.

7. Device as in claim 6, wherein said rails for the holding frame are provided on the periphery of the work area as well as on said turntable.

8. Device as in claim 2 wherein said pivot arms are constructed as articulated hinge arms.

9. Device as in claim 1, wherein all said brick delivery means include gripping means for horizontal gripping and pivoting or vertical gripping and positioning or both.

10. Device as in claim 1, and including a removable transition roller track provided to extend radially outwardly from said distributing means for being operative upon removal of said upper brick delivery means.

* * * * *